US010611002B2

(12) United States Patent
Meoli et al.

(10) Patent No.: US 10,611,002 B2
(45) Date of Patent: Apr. 7, 2020

(54) FIXED ANGLE CLAMPING PLIERS

(71) Applicants: Michael J. Meoli, Bridgewater, MA (US); Dugagjin Dervishaj, Deqan (RS)

(72) Inventors: Michael J. Meoli, Bridgewater, MA (US); Dugagjin Dervishaj, Deqan (RS)

( * ) Notice: Subject to any disclaimer, the term of this patent is extended or adjusted under 35 U.S.C. 154(b) by 97 days.

(21) Appl. No.: 15/591,262

(22) Filed: May 10, 2017

(65) Prior Publication Data

US 2017/0326708 A1 Nov. 16, 2017

Related U.S. Application Data

(60) Provisional application No. 62/336,791, filed on May 16, 2016.

(51) Int. Cl.
*B25B 5/14* (2006.01)
*B25B 7/12* (2006.01)

(52) U.S. Cl.
CPC ..... *B25B 5/14* (2013.01); *B25B 5/142* (2013.01); *B25B 7/123* (2013.01)

(58) Field of Classification Search
CPC ..... B25B 5/145; B25B 5/142; B25B 5/163; B25B 5/14; B25B 7/02; B25B 5/16; B25B 7/04; B25B 7/12; B25B 7/123; B25B 7/22
USPC ..... 81/311, 306; 269/37, 41
See application file for complete search history.

(56) References Cited

U.S. PATENT DOCUMENTS

| | | | | |
|---|---|---|---|---|
| 2,507,368 | A * | 5/1950 | Carlson | B65G 7/12 294/16 |
| 4,238,123 | A * | 12/1980 | Bardes | B25B 5/142 269/228 |
| 9,744,653 | B2 * | 8/2017 | Vaale | B25B 7/123 |
| 9,938,123 | B1 * | 4/2018 | Kravitch | B66F 11/00 |
| 2013/0221593 | A1 * | 8/2013 | Melchior | B25B 5/10 269/107 |

OTHER PUBLICATIONS

Bessey GRZRO 4½-Inch Jaw Capacity 2¾-Inch Throat Depth Pipe Clamp Gripping Plier [https://www.amazon.com/Bessey-2-Inch-Capacity-4-Inch-Gripping/dp/B00018A1LE] (Year: 2004).*

* cited by examiner

*Primary Examiner* — Tyrone V Hall, Jr.
*Assistant Examiner* — Abbie E Quann
(74) *Attorney, Agent, or Firm* — Anderson Gorecki LLP

(57) ABSTRACT

Right angle clamping pliers include a four-bar linkage clamping mechanism coupled to opposing pairs of clamping arms. Any of a variety of detachable clamping members can be attached to each clamping arm. Some clamping members orient the parts being joined. For example, right angle clamping members orient edges and curved C-shaped clamping members orient tubes, pipes and other cylindrical parts. Different types of clamping members can be used in a single configuration to accommodate a wide variety of parts to be joined.

20 Claims, 15 Drawing Sheets

FIXED ANGLE CLAMPING PLIERS

CROSS-REFERENCE TO RELATED APPLICATIONS

A claim of priority is made to U.S. Provisional Patent Application 62/336,791 titled NINETY DEGREE PLIERS, filed May 16, 2016, which is incorporated by reference.

BACKGROUND

The subject matter of this disclosure is generally related to clamps. Clamps can be used to hold different parts together while the parts are being joined. Known types of clamps include spring clamps, C-clamps, pipe clamps, bar clamps, screw clamps and miter clamps. Miter clamps are used to hold two parts in a fixed angular relation while forming a 90° miter joint. In order to form the miter joint each part being joined is first cut at an angle, e.g. beveled at 45°. The beveled edges are then joined together while held in position by the miter clamp. Miter joints are relatively weak but are sometimes used where aesthetic considerations outweigh the need for strength, such as when joining pieces of decorative molding or picture frames.

SUMMARY

All examples, aspects and features mentioned in this document can be combined in any technically possible way.

In accordance with an aspect an apparatus comprises: clamping pliers comprising: a clamping mechanism; first and second clamping arms of a first pair connected at a first distal end to the clamping mechanism, a first predetermined angle defined between the first and second clamping arms; third and fourth clamping arms of a second pair connected at a second distal end to the clamping mechanism, the first predetermined angle defined between the third and fourth clamping arms; first and second clamping members connected to the first and second clamping arms, respectively; and third and fourth clamping members connected to the third and fourth clamping arms, respectively; wherein the clamping mechanism actuates the clamping arms and applies intersecting axes of applied force through the first and third clamping members, and applies intersecting axes of applied force through the second and fourth clamping members. In some implementations the first predetermined angle is 90°. In some implementations the clamping members are detachable from the clamping arms. In some implementations the clamping mechanism comprises a four-bar linkage. In some implementations the first and second clamping members each comprise a base with a planar contact surface that is perpendicular to the axis of force applied there through. In some implementations the first and second clamping members each comprise a rigid base and a resilient foot with a planar contact surface that is perpendicular to the axis of force applied there through. In some implementations the first and second clamping members each comprise a curved contact surface. In some implementations the first and second clamping members each comprise first and second planar members connected along an edge and forming a second predetermined angle, the first planar member perpendicular to the axis of force applied there through. In some implementations the second predetermined angle is 90°. In some implementations the first and second clamping members each comprise first and second planar members connected along an edge and forming a third predetermined angle, the edge being perpendicular to the axis of force applied there through. In some implementations the third predetermined angle is 90°. In some implementations the first and second clamping members each comprise a pointed contact surface that is intersected by the axis of force applied there through. In some implementations the first and second clamping members each comprise a base with an elongated foot and a planar contact surface that is perpendicular to the axis of force applied there through. In some implementations the first and second clamping members each comprise a base with a magnetized foot and a planar contact surface that is perpendicular to the axis of force applied there through. In some implementations the first and second clamping members are of a different type than the third and fourth clamping members.

In accordance with an aspect an apparatus comprises: clamping pliers comprising: a four-bar linkage clamping mechanism; first and second clamping arms of a first pair connected at a first distal end to the clamping mechanism, a first predetermined angle defined between the first and second clamping arms; third and fourth clamping arms of a second pair connected at a second distal end to the clamping mechanism, the first predetermined angle defined between the third and fourth clamping arms; and first and second clamping members connected to the first and second clamping arms, respectively; wherein the clamping mechanism actuates the clamping arms and applies intersecting axes of applied force through the first and third clamping arms, and applies intersecting axes of applied force through the second and fourth clamping arms. Some implementations comprise third and fourth clamping members connected to the third and fourth clamping arms, respectively. In some implementations the first and second clamping members comprise first and second planar members connected along an edge and forming a second predetermined angle of 90°, the first planar member perpendicular to the axis of force applied there through. In some implementations the third and fourth clamping members each comprise a base with a planar contact surface that is perpendicular to the axis of force applied there through.

In accordance with an aspect an apparatus comprises: clamping pliers comprising: a four-bar linkage clamping mechanism; first and second clamping arms of a first pair connected at a first distal end to the clamping mechanism, an angle of 90° defined between the first and second clamping arms; third and fourth clamping arms of a second pair connected at a second distal end to the clamping mechanism, an angle of 90° defined between the third and fourth clamping arms; first and second detachable clamping members connected to the first and second clamping arms, respectively; and third and fourth detachable clamping members connected to the third and fourth clamping arms, respectively; wherein the clamping mechanism actuates the clamping arms and applies intersecting axes of applied force through the first and third clamping members, and applies intersecting axes of applied force through the second and fourth clamping members.

DETAILED DESCRIPTION

Figure 1:
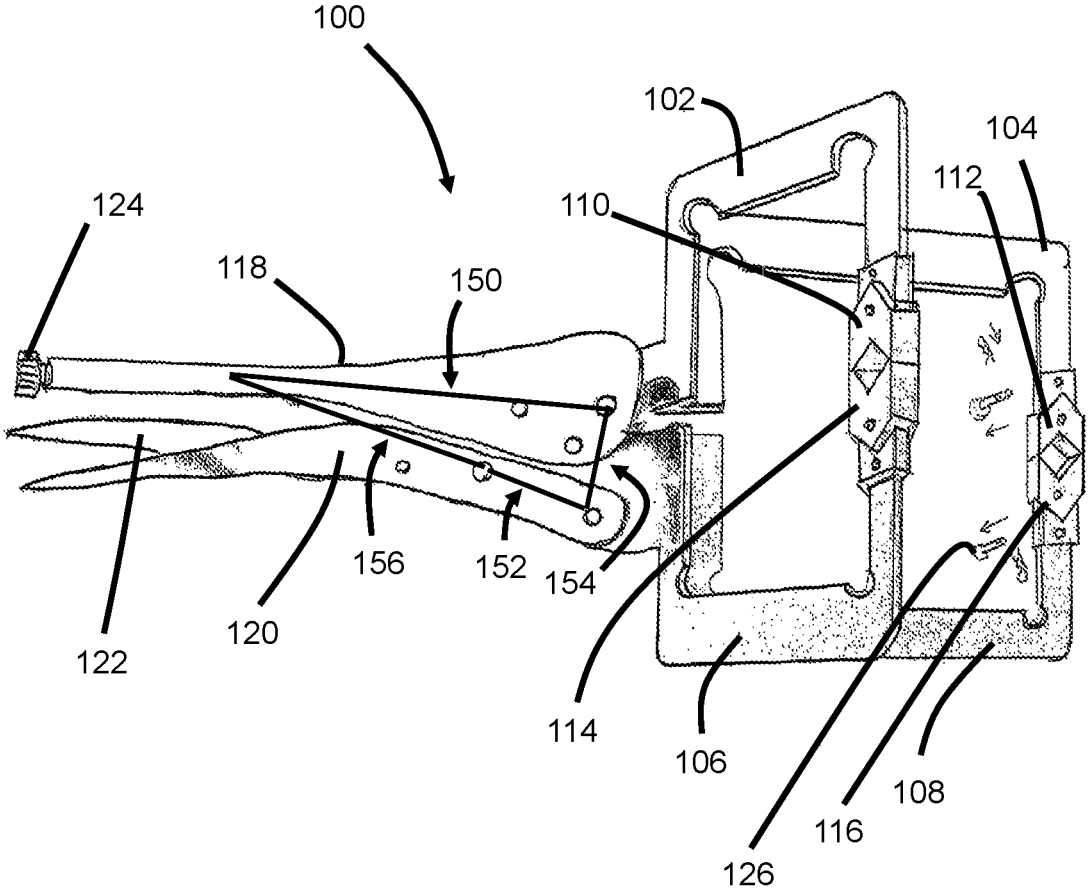
FIG. 1 illustrates an implementation of fixed angle clamping pliers.

Referring to FIG. 1, an implementation of fixed angle clamping pliers includes a clamping mechanism 100, opposing pairs of clamping arms 102, 104 and 106, 108, and pairs of clamping members 110, 112, and 114, 116. The clamping mechanism 100 is pivotally linked to a first distal end of each clamping arm 102, 104, 106, and 108. A second distal end of each clamping arm is connected to one of the clamping members 110, 112, 114, 116. More particularly, first and second clamping members 110, 112 are attached to a first set of clamping arms 102, 104, and third and fourth clamping members 114, 116 are attached to a second set of clamping arms 106, 108. The first and third clamping members 110, 114 form an aligned pair between which a first part is clamped. The second and fourth clamping members 112, 116 form an aligned pair between which a second part is clamped while being joined to the first part.

Figure 2:
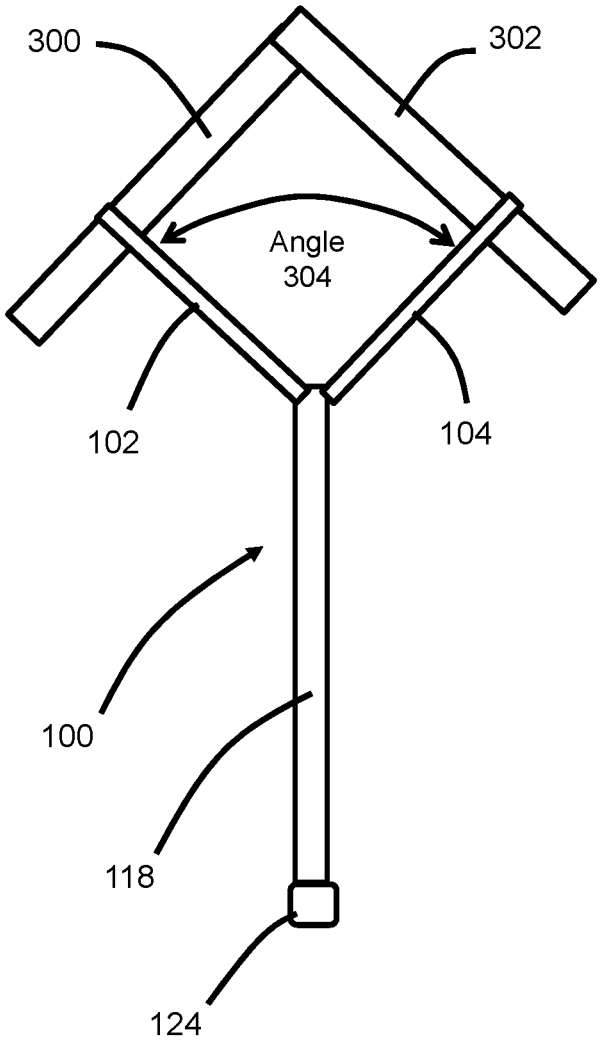
FIG. 2 illustrates the fixed angle between clamping arms.

Referring to FIGS. 1 and 2, the clamping arms of each set 102, 104 and 106, 108 may be fixed at an angle 304 relative to each other. For example and without limitation, the angle 304 between clamping arms 102, 104 may be 90°, 45° or any other of a wide variety of angles at which the parts 300, 302 are to be joined. In order for clamping members 110, 114 to align with each other, and for clamping members 112, 116 to align with each other, clamping arms 102, 104 are aligned with clamping arms 106, 108, respectively, and clamping arms 102, 104 are offset from each other by the same angle as clamping arms 106, 108 are offset from each other. As will be explained in greater detail below, the clamping members 110, 112, 114, 116 may help to align the two parts 300, 302 being joined, e.g. at an angle relative to the clamping arms to create a joint that matches the angle 304.

Figure 3:
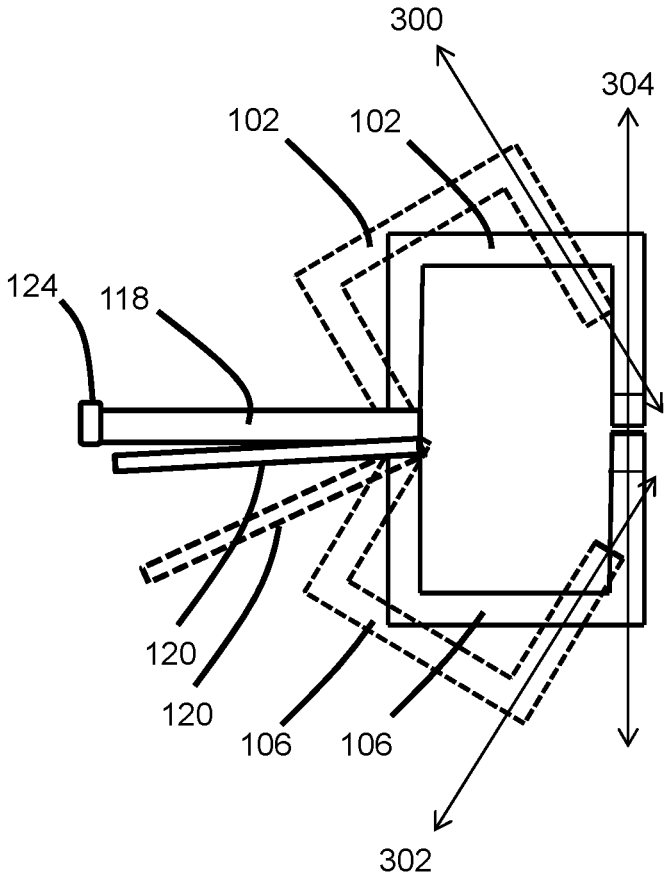
FIG. 3 illustrates the clamping mechanism and axes of applied force.

Referring to FIGS. 1 and 3, a wide variety of clamping mechanisms could be used. Examples may include but are not limited to a four-bar linkage, such as used with mole grips and vice grips, spring clamp mechanisms, and bar clamp mechanisms. The specifically illustrated clamping mechanism 100 is a type of four-bar linkage. Handles 118, 120 form two of the bars 150, 152 of the linkage. The handles are linked via first and second bars 154, 156 (see also FIG. 14). Squeezing the handles together causes the first bar 154 to pivot relative to the second bar 156. The second bar is a locking bar that can be pivoted into an over-center position. More particularly, the angle between bar 152 and second bar 156 changes from an obtuse angle facing in a first direction, to alignment at 180°, and then to an obtuse angle facing in the opposite direction, which is the over-center position. In the over-center position a force acting to push the clamping members apart will tend to force the handles together, thereby inhibiting release of the linkage. Actuating a release lever 122 adjusts the bars to reverse the direction of the angle between the first bar and the second bar. The clamping arms 102, 104, 106, and 108 open freely when the angle is 180°. The first and second bars and the handles, which are also bars, form the four-bar linkage. Four-bar linkages, spring clamps and bar clamps are understood in the mechanical engineering arts.

Referring now to FIGS. 1 through 3, in order to configure the clamping pliers to hold the parts 300, 302 in place for joining, the space between aligned pairs of clamping members 110, 114 and 112, 116 is adjusted. For example, with the clamping pliers in the closed and locked position, a threaded bolt 124 is turned in order to pivot the clamping arms 102, 104 relative to the clamping mechanism. Turning the threaded bolt changes the location of the rear pivot point of the locking bar, and thereby the over-center locking position. As a result, the spacing between aligned pairs of clamping members changes. The spacing is typically adjusted such that the distance between aligned pairs of clamping arms is slightly smaller than the thickness of the parts to be clamped. Compression and tension of the bars provides the force to secure the parts in place when the clamping pliers are in the closed and locked position. Each clamping arm 102, 106 presents an axis 300, 302 along which force is applied, e.g. to a part, via the clamping members. When the clamping arms are fully closed the two axes align in a common axis 304. Depending on the thickness of the parts to be clamped the clamping arms may not achieve the common axis 304 of clamping force when the parts are secured and the clamping pliers are in the closed, locked position. However, the clamping members may help to maintain the parts in place.

The clamping members 110, 112, 114, 116 may be connected to the clamping arms 102, 104, 106, 108 using mechanical fasteners 126 or tool-free connection means that enable different types of clamping members to be installed and used for different clamping tasks. A wide variety of different types of clamping members could be implemented and provided with the clamping pliers, e.g. as a kit. For some tasks it may be desirable to use different types of clamping members together. Some examples of clamping members are described below.

Figure 4:
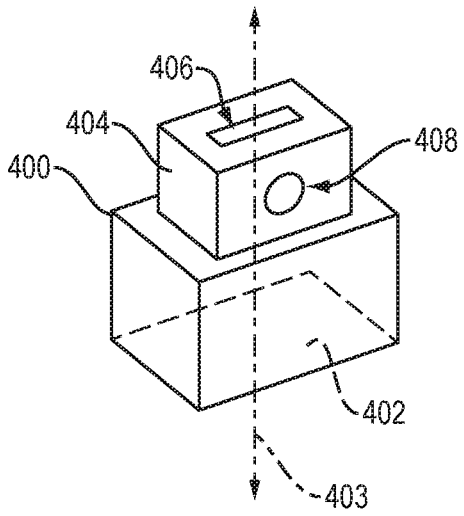
FIG. 4 illustrates a universal clamping member.

Referring to FIG. 4, a universal clamping member includes a cuboid (or other shape) base 400 with a planar contact surface 402. The planar contact surface 402 is perpendicular to an axis 403 of force applied by the corresponding clamping arm on which it is mounted. In general, the part being clamped can be rotated in the plane of the contact surface for positioning prior to clamping. The contact surface of the clamping member may be selected such that the force per unit area applied will be sufficient to hold a particular type of material without causing damage thereto. An attachment interface 404 includes a slot 406 that receives the clamping arm and a threaded opening 408 into which a fastener is inserted in order to install the clamping member on the clamping arm. The universal clamping member may be solid metal and may be suited for clamping parts that present a planar surface against which the clamping member is disposed.

Figure 5:
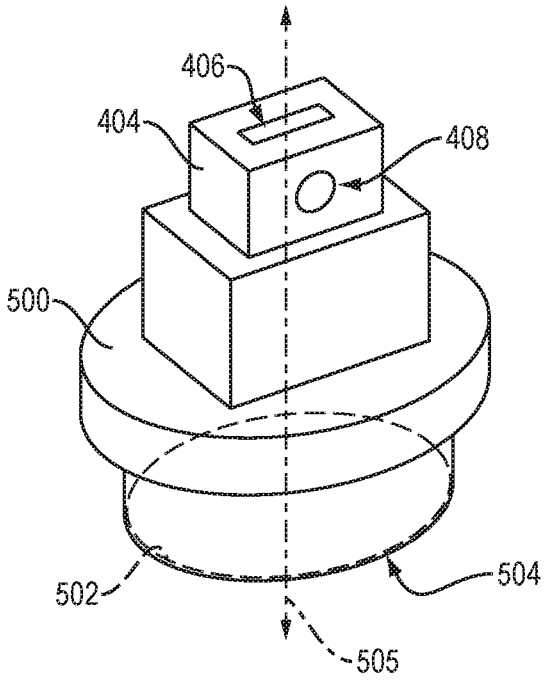
FIG. 5 illustrates a resilient clamping member.

Referring to FIG. 5, a resilient clamping member includes a rigid base 500 and a resilient foot 502 with a planar contact surface 504. In the illustrated example both the rigid base and resilient foot are solid elliptic cylinders. The planar contact surface 504 is perpendicular to the axis 505 of force applied by the corresponding clamping arm on which it is mounted. The part being clamped can be rotated in the plane of the contact surface for positioning prior to clamping. An attachment interface 404 includes a slot 406 that receives the clamping arm and a threaded opening 408 into which a fastener is inserted in order to install the clamping member on the clamping arm. The resilient foot contact surface may have a higher static frictional coefficient than the planar contact surface of the universal clamping member depicted in FIG. 4. The contact surface of the clamping member may be selected such that the force per unit area applied will be sufficient to hold a particular type of material without causing damage thereto. The resilient clamping member may be particularly suited for clamping parts that present a smooth surface or an easily scratched surface against which the clamping member is disposed.

Figure 6:
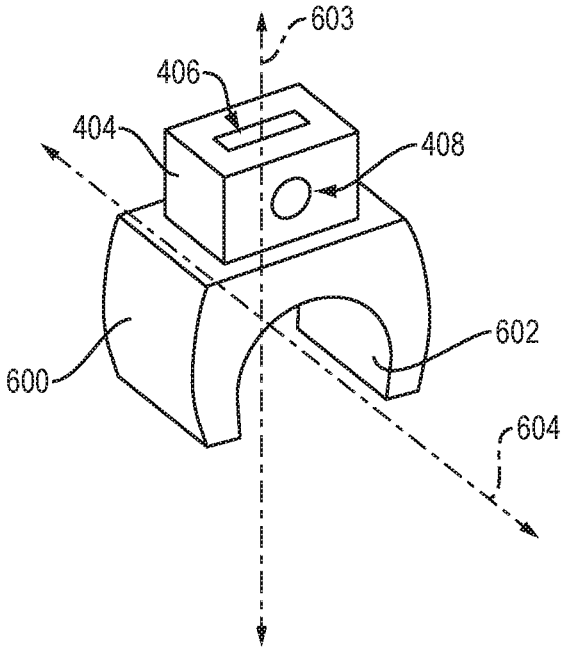
FIG. 6 illustrates a rounded clamping member.

Referring to FIGS. 2 and 6, a rounded clamping member includes a C-shaped base 600 and an attachment interface 404 with a slot 406 and a threaded opening 408. The C-shaped base 600 may present a curved contact surface 602 that is semi-circular in cross-section. An axis 603 of force applied by the clamping arm is perpendicular to a line that bisects the semi-cylindrical contact surface 602. The C-shaped base tends to orient the part being clamped. More particularly, the part being clamped is oriented lengthwise along an axis 604 that is perpendicular to the C-shaped base. Consequently, the cylindrical part being clamped is not free to rotate and will be oriented to form angle 304 relative to the other part being clamped. The C-shaped base may be suited to clamping tubing, pipe, hose and other cylindrical parts. The contact surface may be coated to protect the stock, for example and without limitation chrome plated or painted parts. A kit might include rounded clamping member with a variety of different diameters, e.g. for use with different standard sizes of tubing and pipe.

Figure 7:
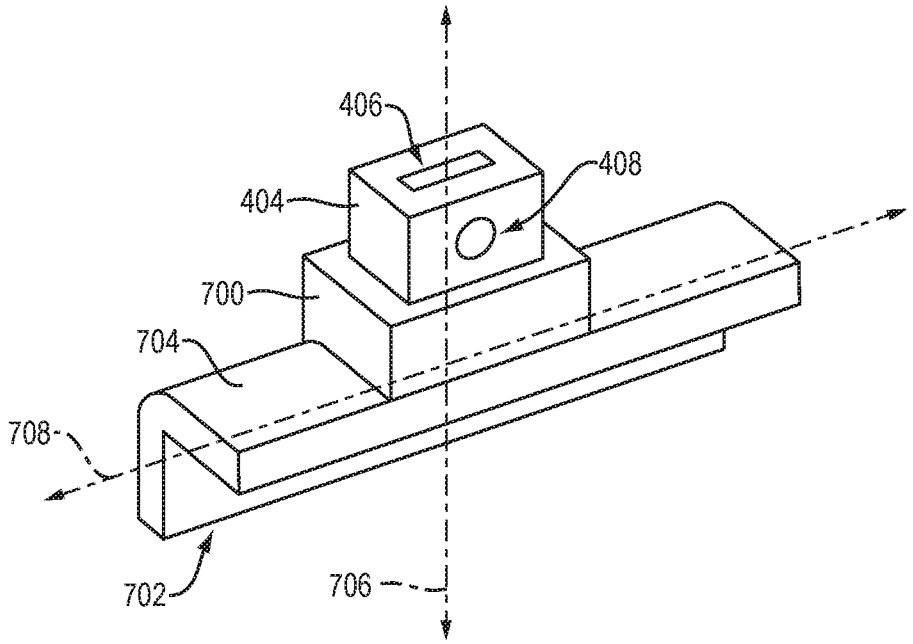
FIG. 7 illustrates an edge clamping member.

Referring to FIGS. 2 and 7, an edge clamping member includes an L-shaped base 700 and an attachment interface 404 with a slot 406 and a threaded opening 408. The L-shaped base 700 includes two planar members 702, 704 oriented and connected along an edge at a predetermined angle, e.g. and without limitation 90°. The planar members 702, 704 thus present an L-shaped cross-section with contact surfaces at the predetermined angle. The planar contact surface of planar member 704 is perpendicular to the axis 706 of force of the corresponding clamping arm on which it is mounted. The planar contact surface of planar member 702 is parallel to the axis 706 of force of the corresponding clamping arm on which it is mounted. The L-shaped base tends to orient the edge of the part being clamped relative to the L-shaped base. More particularly, faces of the part are disposed against the contact surfaces and an edge of the part where the faces meet is oriented along an axis 708 that is co-planar with the planar contact surfaces and at a right angle offset relative to the axis 706 of force. Consequently, the part being clamped is not free to rotate and will be oriented to form angle 304 relative to the other part being clamped. The edge clamping member may be suited to clamping cuboid shaped parts, e.g. boards.

Figure 8:
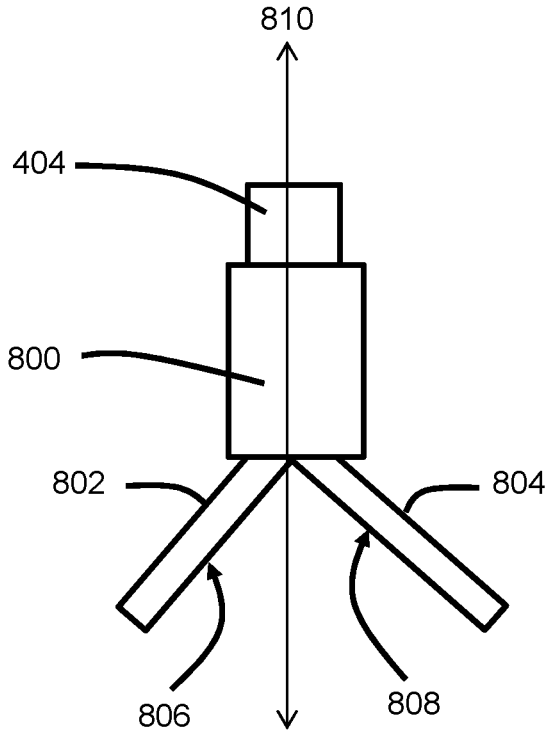
FIG. 8 illustrates an offset edge clamping member.

Referring to FIGS. 2 and 8, an offset edge clamping member includes an offset L-shaped base 800 and an attachment interface 404 with a slot and a threaded opening. The offset L-shaped base 800 includes two planar members 802, 804 oriented and connected along an edge at a predetermined angle, e.g. 90°. The planar members 802, 804 thus present an L-shaped cross-section with contact surfaces 806, 808 at the predetermined angle. The planar contact surfaces 806, 808 are each disposed at an angle relative to the axis 810 of force of the corresponding clamping arm on which it is mounted. For example, the planar contact surfaces 806, 808 may be each be offset by 45° from the axis 810 in opposite directions. However, the offset angles need not be equal and the angle between the contact surfaces need not be 90°. The L-shaped base tends to center an edge of the part being clamped along the edge where the two contact surfaces meet, which is perpendicular to the axis 810 of force. Consequently, the part being clamped is not free to rotate and will be oriented to form angle 304 relative to the other part being clamped. The edge clamping member may be suited to clamping cuboid shaped parts, e.g. boards.

Figure 9:
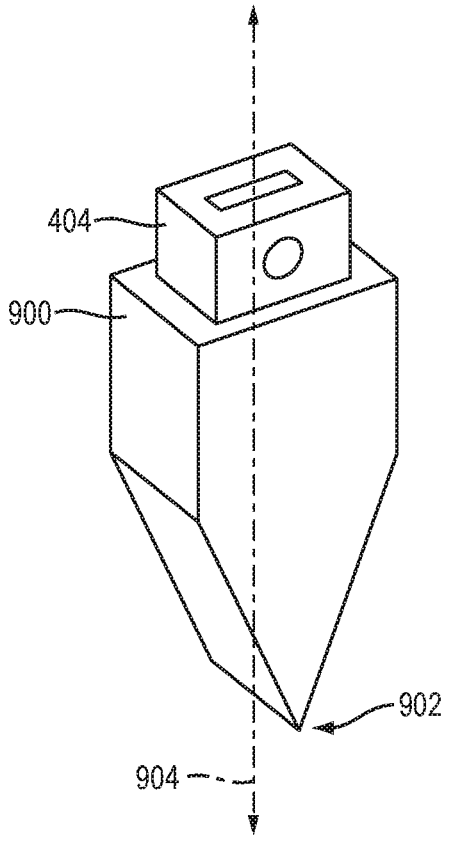
FIG. 9 illustrates a pointed clamping member.

Referring to FIG. 9, a pointed clamping member includes a thin cuboid block base 900 with a pointed contact surface 902. The pointed contact surface 902 is in the axis 904 of force applied by the corresponding clamping arm on which it is mounted. An attachment interface 404 includes a slot that receives the clamping arm and a threaded opening into which a fastener is inserted in order to install the clamping member on the clamping arm. In general, the part being clamped can be moved, e.g., tilted and pivoted relative to the pointed contact surface, for positioning prior to clamping. The pointed clamping member may be solid metal and may be suited for clamping parts with irregular shapes or surfaces.

Figure 10:
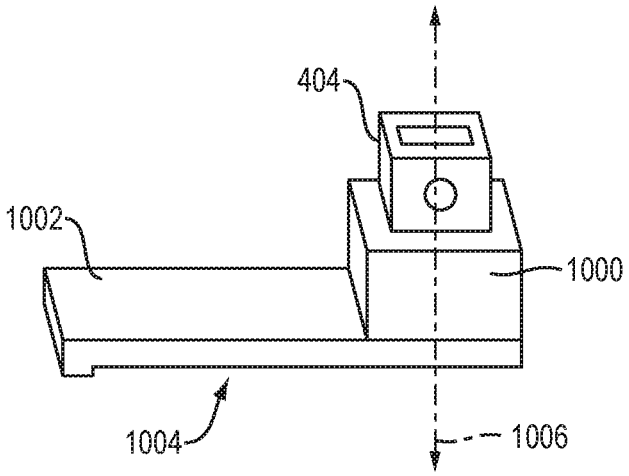
FIG. 10 illustrates an extended foot clamping member.

Referring to FIG. 10, an extended foot clamping member includes a cuboid base 1000 with a foot 1002 and a planar contact surface 1004. The planar contact surface 1004 is perpendicular to an axis 1006 of force applied by the corresponding clamping arm on which it is mounted. In general, the part being clamped can be rotated in the plane of the contact surface for positioning prior to clamping. The contact surface of the clamping member may be selected such that the force per unit area applied will be sufficient to hold a particular type of material without causing damage thereto. An attachment interface 404 includes a slot that receives the clamping arm and a threaded opening into which a fastener is inserted in order to install the clamping member on the clamping arm. The universal clamping member may be solid metal and may be suited for clamping parts that present a planar surface against which the clamping member is disposed.

Figure 11:
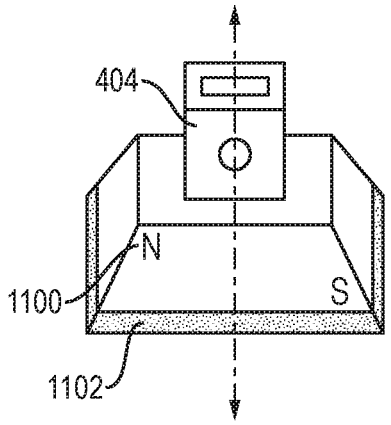
FIG. 11 illustrates a magnetic foot clamping member.

Referring to FIG. 11, a magnetic foot clamping member includes a cuboid base 1100 with a magnetized foot 1102 and a planar contact surface 1104. The planar contact surface 1104 is perpendicular to an axis 1106 of force applied by the corresponding clamping arm on which it is mounted. In general, the part being clamped can be rotated in the plane of the contact surface for positioning prior to clamping. The contact surface of the clamping member may be selected such that the force per unit area applied will be sufficient to hold a particular type of material without causing damage thereto. An attachment interface 404 includes a slot that receives the clamping arm and a threaded opening into which a fastener is inserted in order to install the clamping member on the clamping arm. The universal clamping member may be solid metal and may be suited for clamping parts that present a planar surface against which the clamping member is disposed.

Figure 12:
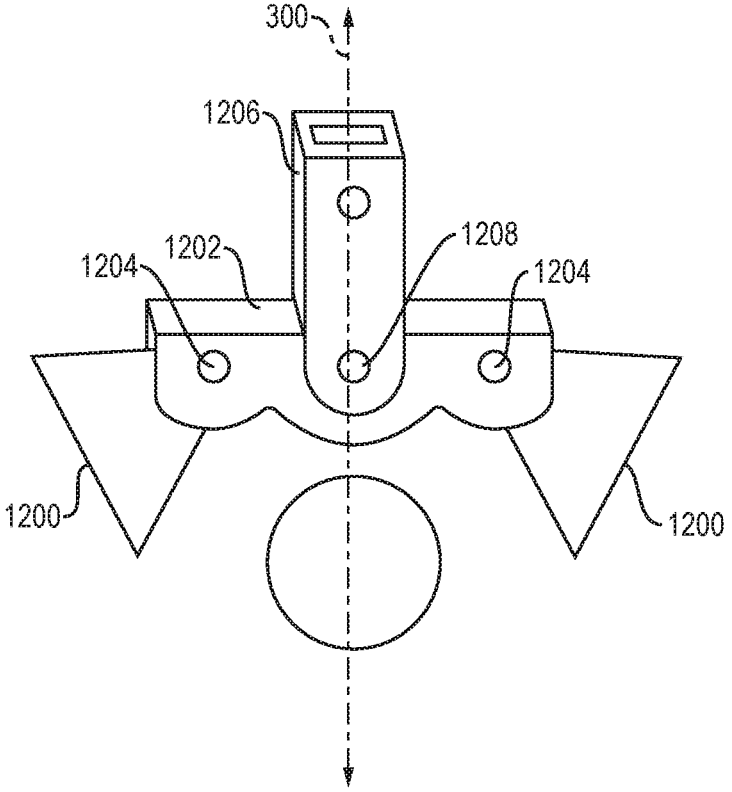
FIG. 12 illustrates a round stock clamping member.

FIG. 12 illustrates a round stock clamping member. Adapter tips 1200 are pivotally connected to a connecting member 1202 via hinges 1204. The connecting member may be attached to a base 1206 via a hinge 1208. The adapter tips pivotally self-adjust to hold round pipe stock of different diameters.

Figure 13:
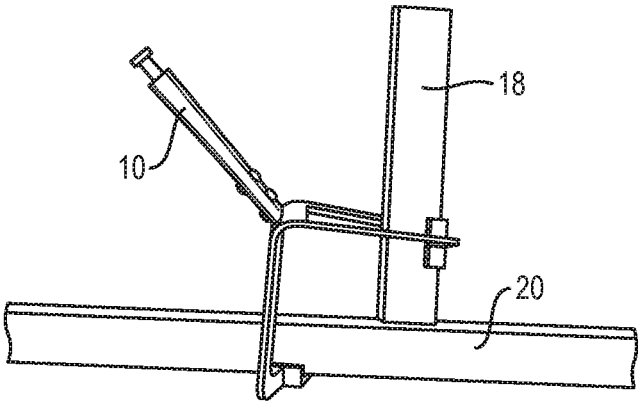
FIG. 13 illustrates the clamping pliers configured with four edge clamping members as depicted in FIG. 7.

FIG. 13 illustrates the clamping pliers 10 configured with four edge clamping members as depicted in FIG. 7. The edge clamping members are orienting the outer edges of boards 18, 20 to clamp the boards at an angle of 90°. Note that the boards are not being joined with a miter joint, although it would be possible to do so.

Figure 14:
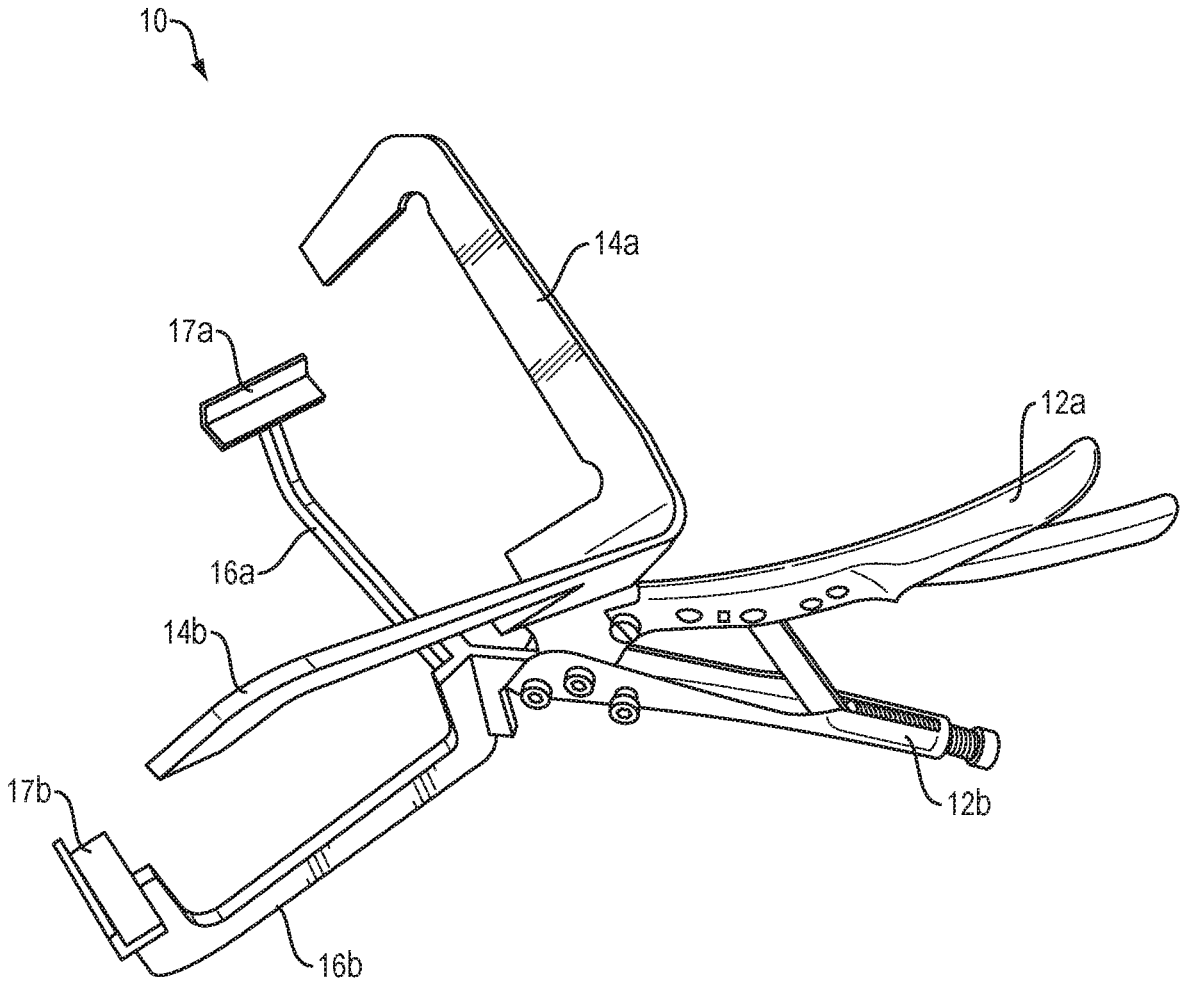
FIGS. 14 and 15 illustrate the clamping pliers configured with two edge clamping members, wherein leading edge of each clamping arm is used as a contact surface.
Figure 15:
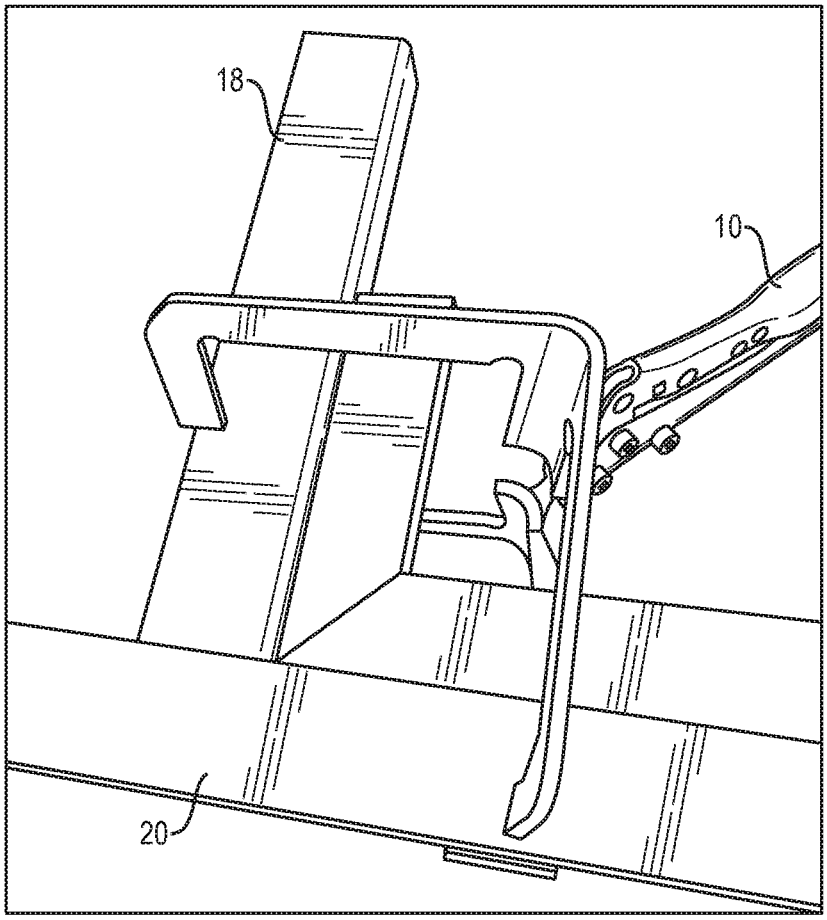

FIG. 14 illustrates the clamping pliers 10 configured with two edge clamping members 17*a*, 17*b* (such as illustrated in FIG. 8). In particular, edge clamping member 17*a* is mounted on clamping arm 16*a* and edge clamping member 17*b* is mounted on clamping arm 16*b*. Clamping arms 14*a* and 14*b* do not have clamping members mounted thereon. Rather, a leading edge of each clamping arm will be used as the contact surface. FIG. 15 depicts the clamping pliers 10 configured as in FIG. 14 being used to clamp two parts.

A number of features, aspects, embodiments and implementations have been described. Nevertheless, it will be understood that a wide variety of modifications and combinations may be made without departing from the scope of the inventive concepts described herein. Accordingly, those modifications and combinations are within the scope of the following claims.

What is claimed is:

1. An apparatus comprising:

clamping pliers for holding a first part at a first predetermined angle relative to a second part, comprising:

a four-bar linkage clamping mechanism comprising a first handle and a second handle that move pivotally in a first plane;

first and second adjacent clamping arms of a first pair that are angularly offset from each other by the first predetermined angle, the first and second adjacent clamping arms connected at a first distal end, the first distal end of the first pair connected to the clamping mechanism such that the first predetermined angle of the angular offset is bisected by the first plane in which the first handle and the second handle move pivotally;

third and fourth adjacent clamping arms of a second pair that are angularly offset from each other at the first predetermined angle, the third and fourth adjacent clamping arms connected at a second distal end, the second distal end of the second pair connected to the clamping mechanism such that the first predetermined angle of the angular offset is bisected by the first plane in which the first handle and the second handle move pivotally;

first and second clamping members connected to the first and second clamping arms, respectively; and third and fourth clamping members connected to the third and fourth clamping arms, respectively;

wherein the clamping mechanism applies intersecting axes of applied force through the first and third clamping members for holding only the first part and applies intersecting axes of applied force through the second and fourth clamping members for holding only the second part, and wherein a distance between the first clamping member and the third clamping member is equal to a distance between the second clamping member and the fourth clamping member.

2. The apparatus of claim 1 wherein the first predetermined angle is 90°.

3. The apparatus of claim 1 wherein the first, second, third, and fourth clamping members are detachable.

4. The apparatus of claim 3 wherein the clamping mechanism comprises a four-bar linkage.

5. The apparatus of claim 1 wherein the first and second clamping members each comprise a base with a planar contact surface that is perpendicular to the axis of force applied there through.

6. The apparatus of claim 1 wherein the first and second clamping members each comprise a rigid base and a resilient foot with a planar contact surface that is perpendicular to the axis of force applied there through.

7. The apparatus of claim 1 wherein the first and second clamping members each comprise a curved contact surface.

8. The apparatus of claim 1 wherein the first and second clamping members each comprise first and second planar members connected along an edge and forming a second predetermined angle, the first planar member perpendicular to the axis of force applied there through.

9. The apparatus of claim 8 wherein the second predetermined angle is 90°.

10. The apparatus of claim 1 wherein the first and second clamping members each comprise first and second planar members connected along an edge and forming a third predetermined angle, the edge being perpendicular to the axis of force applied there through.

11. The apparatus of claim 10 wherein the third predetermined angle is 90°.

12. The apparatus of claim 1 wherein the first and second clamping members each comprise a pointed contact surface that is intersected by the axis of force applied there through.

13. The apparatus of claim 1 wherein the first and second clamping members each comprise a base with an elongated foot and a planar contact surface that is perpendicular to the axis of force applied there through.

14. The apparatus of claim 1 wherein the first and second clamping members each comprise a base with a magnetized foot and a planar contact surface that is perpendicular to the axis of force applied there through.

15. The apparatus of claim 1 wherein the first and second clamping members are of a different type than the third and fourth clamping members.

16. An apparatus comprising:

clamping pliers for holding a first part at a first predetermined angle relative to a second part, comprising:

a four-bar linkage clamping mechanism comprising a first handle and a second handle that move pivotally in a first plane;

first and second adjacent clamping arms of a first pair that are angularly offset from each other by the first predetermined angle, the first and second adjacent clamping arms connected at a first distal end, the first distal end of the first pair connected to the clamping mechanism such that the first predetermined angle of the angular offset is bisected by the first plane in which the first handle and the second handle move pivotally;

third and fourth adjacent clamping arms of a second pair that are angularly offset from each other at the first predetermined angle, the third and fourth adjacent clamping arms connected at a second distal end, the second distal end of the second pair connected to the clamping mechanism such that the first predetermined angle of the angular offset is bisected by the first plane in which the first handle and the second handle move pivotally;

wherein the clamping mechanism applies intersecting axes of applied force through the first and third clamping arms for holding only the first part and applies intersecting axes of applied force through the second and fourth clamping arms for holding only the second part.

17. The apparatus of claim 16 comprising third and fourth clamping members connected to the third and fourth clamping arms, respectively.

18. The apparatus of claim 17 wherein the first and second clamping members comprise first and second planar members connected along an edge and forming a second predetermined angle of 90°, the first planar member perpendicular to the axis of force applied there through.

19. The apparatus of claim 18 wherein the third and fourth clamping members each comprise a base with a planar contact surface that is perpendicular to the axis of force applied there through.

20. An apparatus comprising:

clamping pliers for holding a first part at a 90° angle relative to a second part, comprising:

a four-bar linkage clamping mechanism comprising a first handle and a second handle that move pivotally in a first plane;

first and second adjacent clamping arms of a first pair that have a first length and are angularly offset from each other at 90°, the first and second adjacent clamping arms connected at a first distal end, the first distal end of the first pair connected to the clamping mechanism such that the 90° angular offset is bisected by the first plane in which the first handle and the second handle move pivotally;

third and fourth adjacent clamping arms of a second pair that have the first length and are angularly offset from each other at 90°, the third and fourth adjacent clamping arms connected at a second distal end, the second distal end of the second pair connected to the clamping mechanism such that the 90° angular offset is bisected by the first plane in which the first handle and the second handle move pivotally;

first and second detachable clamping members connected to the first and second clamping arms, respectively; and third and fourth detachable clamping members connected to the third and fourth clamping arms, respectively;

wherein the clamping mechanism applies intersecting axes of applied force through the first and third clamping members for holding only the first part and applies intersecting axes of applied force through the second and fourth clamping members for holding only the second part, and wherein a distance between the first clamping member and the third clamping member is equal to a distance between the second clamping member and the fourth clamping member.

* * * * *